US008286719B2

(12) United States Patent
Vetesnik

(10) Patent No.: US 8,286,719 B2
(45) Date of Patent: Oct. 16, 2012

(54) COMPRESSED AIR FOAM SYSTEM FOR FIRE RETARDANCE

(75) Inventor: Jan Vetesnik, Winnipeg (CA)

(73) Assignee: Tuffbuilt Products Inc, Winnipeg, Manitoba (CA)

( * ) Notice: Subject to any disclaimer, the term of this patent is extended or adjusted under 35 U.S.C. 154(b) by 343 days.

(21) Appl. No.: 12/405,380

(22) Filed: Mar. 17, 2009

(65) Prior Publication Data

US 2010/0236799 A1 Sep. 23, 2010

(51) Int. Cl.
*A62C 35/00* (2006.01)

(52) U.S. Cl. ..... 169/14; 169/70; 169/54; 169/60; 169/13; 169/27

(58) Field of Classification Search ..... 169/44, 169/46, 47, 54, 60, 61, 70, 13, 14, 15, 27
See application file for complete search history.

(56) References Cited

U.S. PATENT DOCUMENTS

| | | | | |
|---|---|---|---|---|
| 5,125,458 | A | 6/1992 | Berman | |
| 5,165,482 | A | 11/1992 | Smagac | |
| 5,398,765 | A * | 3/1995 | Worthington | 169/52 |
| 5,582,776 | A | 12/1996 | Crawley | |
| RE36,196 | E * | 4/1999 | Eberhardt | 169/14 |
| 5,936,531 | A * | 8/1999 | Powers | 340/628 |
| 6,086,052 | A * | 7/2000 | Rowe | 261/18.1 |
| 6,367,560 | B1 * | 4/2002 | de Ris et al. | 169/43 |
| 6,450,264 | B1 | 9/2002 | Christian | |
| 6,502,765 | B1 * | 1/2003 | Chase | 239/227 |
| 6,519,901 | B1 * | 2/2003 | Nelson et al. | 52/101 |
| 6,523,616 | B1 | 2/2003 | Wallace | |
| 6,684,959 | B1 * | 2/2004 | Juidici et al. | 169/44 |
| 6,733,004 | B2 * | 5/2004 | Crawley | 261/18.1 |
| 6,994,282 | B2 * | 2/2006 | Trapp et al. | 239/587.2 |
| 7,104,334 | B2 | 9/2006 | Thompson | |
| 2008/0061172 | A1 * | 3/2008 | Trapp et al. | 239/587.5 |

* cited by examiner

*Primary Examiner* — Dinh Q Nguyen
*Assistant Examiner* — Trevor E McGraw
(74) *Attorney, Agent, or Firm* — Adrian D Battison; Ade & Company Inc.

(57) ABSTRACT

An apparatus for protecting a structure from fire includes a foam generation system by mixing compressed air, water from a pump and a foaming agent from a metered supply together with a series of motor driven nozzles and a control device which is programable to provide a program of operation to control the motors of the nozzles so as to pre-determine a pattern by which a building is repeatedly covered by a layer of the foam. The control device can include plurality of different programs of operation of the nozzles with different times for different fire conditions. A remote control allows the apparatus to be activated from a safe remote location. An arrangement is provided to automatically start the foam generation system including an internal combustion engine.

17 Claims, 3 Drawing Sheets

102
FOAM DISCHARGE SYSTEM
13
NEGATIVE (-)
POSTIVE (+)
PRIMER
16B
WATER SUPPLY
11
THROTTLE
41
ENGINE
40
STARTER MOTOR
42
PROCESSOR
50
START
51
RPM SENSOR
43
16A
17
18
19
12B
FOAMING AGENT SUPPLY 2
12
FOAMING AGENT SUPPLY 1
12A
COMPRESSED AIR SUPPLY
10
SENSOR
10C
COMPRESSOR
10A
VALVE
10B
16
20
25
21
22
23
15
14
26
27
28
29
30

COMPRESSED AIR FOAM SYSTEM FOR FIRE RETARDANCE

This invention relates to a compressed air foam generation system for protecting a structure from fire and to a programable nozzle for use in the system.

BACKGROUND OF THE INVENTION

For some time foaming agents have been used to increase the effectiveness of water in the prevention and suppression of fires. Systems have traditionally used foaming agents, commonly known as surfactants, mixed in holding tanks or introduced into the water stream by a variety of methods. More recently systems have been developed which also provide for the injection of compressed air into the water/surfactant mixture to provide an improved quality and volume of foam.

In U.S. Pat. No. 5,582,776 of the present inventors issued Dec. 10, 1996 is disclosed a portable apparatus for generating foam. The apparatus disclosed was particularly directed at an apparatus for making compressed air foam to be used in stationary or portable fire fighting systems and emergency response units. The system is particularly applicable to portable systems used in forestry, structure protection, rural and urban grass fires (Class A fires), and oil and gas fires (Class B fires).

In U.S. Pat. No. 6,733,004 of one of the present inventors issued May 11, 2004 is disclosed a portable apparatus for generating foam where there is provided an improved valve arrangement for controlling the formation of the foam.

The arrangement shown in the above patents was particularly designed as a portable unit for use in remote locations.

It is known that foam systems of this type can act to extinguish fires and also as a fire retardant.

U.S. Pat. No. 6,522,616 (Wallace) issued Feb. 25, 2003 discloses a fire prevention system for a building which has foam nozzles outside the building and on the roof.

U.S. Pat. No. 7,104,334 (Thompson) issued Sep. 12, 2006 discloses a portable remote actuable foam spray system which can be left in place when the persons depart and activated remotely. It shows in FIGS. 7 to 9 a roof mounted nozzle.

U.S. Pat. No. 5,165,482 (Smagac) issued Nov. 24, 1992 discloses a sprinkler system for protecting a building when a fire approaches. It does not use foam.

U.S. Pat. No. 6,450,264 (Christian) issued Sep. 17, 2002 discloses a roof mounted sprinkler system for forest fires. It does not use foam.

U.S. Pat. No. 5,125,458 (Berman) issued Jan. 30, 1992 discloses a sprinkler system for protecting a building when a fire approaches. It does not use foam.

SUMMARY OF THE INVENTION

It is one object of the present invention to provide an improved apparatus for fire retardance.

According to a first aspect of the invention there is provided an apparatus for protecting a structure from fire comprising:

a source of compressed air under pressure;

a pump for pumping water to be foamed having a pump inlet for connection to a water supply and a pump outlet;

a source of a foaming agent;

a mixing system for mixing the water, the compressed air and the foaming agent to generate a fire retardant foam;

at least one nozzle for spraying the foam;

each nozzle or nozzles having a motor arrangement to move the nozzle to different directions for spraying a pattern;

and a control device which is programable to provide a program of operation to control the motor or motors so as to pre-determine the pattern.

Preferably there is provided a plurality of nozzles and the control device is arranged to control the nozzles each of which is separately programable.

Preferably the nozzles are arranged to combine to cover a structure to be protected.

Preferably there is provided a remote control for communication with the control device for remote actuation.

Preferably the remote control is arranged to select from a plurality of predetermined programs of operation of the nozzle or nozzles.

Preferably the control device is programable to operate the nozzle or nozzles periodically with the time between operations being programable.

Preferably the control device is programable to operate the nozzle or nozzles periodically with the time period of operation being controllable Preferably there is provided a remote control for communication with the control device and wherein the remote control is arranged to select one of a plurality of programs of operation.

Preferably the nozzle or nozzles are controlled so as to scan in two orthogonal directions to form the pattern.

Preferably the distance movable in each of the direction is programable.

Preferably the movement is programable to follow a surface to be covered by the foam.

Preferably there are a plurality of nozzles with each nozzle programmed to apply a specific pattern different from one or more of the other nozzles.

Preferably the control device is programmed to cycle from one nozzle to another at two or more rates depending on the intensity of the fire.

Preferably there is provided a heat seeking sensor to apply foam to a specific heat location when detected.

Preferably the/or each nozzle uses only 40-60 gallons per minute of water to apply fire protection foam.

Preferably the/or each nozzle is arranged reach up to 80 feet (30 meters) at a 45° angle.

Preferably the system is arranged as a self-contained system so that it does not depend upon outside electricity or water.

Preferably the control device is programmed to use plain water with the nozzles to wash the foam away.

Preferably there is provided an internal combustion engine for driving the pump and a compressor for the compressed air.

Preferably there is provided a processor for controlling the starting and operation of the engine, for controlling the compressor and for controlling the pump in response to outputs from sensors such that foam is available to be supplied solely upon supply of an actuation signal from the control device.

Preferably the processor is arranged to be responsive to a first sensor to check for a predetermined minimum rpm to indicate starting of the engine.

Preferably the processor is arranged to be responsive to a first sensor indicating said predetermined minimum rpm to operate the airflow valve to enable the air compressor.

Preferably the processor is arranged to be responsive to a second sensor to detect the presence of air pressure generated by the compressor to actuate ramp up of engine rpm from an idle speed to an operating speed.

Preferably there is provided a pump priming system operable to release any existing air in the pump and wherein the processor is responsive to the absence of pump flow detected by the third sensor to actuate the pump priming system.

Preferably there is provided a pressure balance valve for controlling the supply of air and water and wherein the processor is responsive to the detection of water flow by the third sensor to actuate the pressure balance valve.

According to a second aspect of the invention there is provided a nozzle assembly for spraying foam for protecting a structure from fire comprising:

the nozzle having a motor arrangement to move the nozzle to different directions for spraying a pattern;

and a control device which is programable to provide a program of operation to control the motor or motors so as to pre-determine the pattern.

The system can be programmed in several ways.

1. Cycled nozzles where there are several nozzles each nozzle would be programmed to apply a specific pattern. The system could be programmed to cycle from one nozzle to another at two or more rates depending on the intensity of the fire. (Protection or Fire fighting.)

2. Single nozzle where there is a smaller exposure a single nozzle could be programmed to apply foam at a specific frequency or continuously.

3. Fire seeking where a heat seeking sensor can be added to apply foam to a specific heat source either as a primary program or as an over-ride to a cycling program as indicated in 1 or 2.

The device combines advanced technologies to provide the best available automatic fire defence.

The device has a nozzle which uses only 40-60 gallons per minute of water to apply fire protection foam. This is the same or better than 1200 gallons per minute of water being sprayed upon a building continuously.

The device has a nozzle which reaches up to 80 feet (30 meters) at a 45° angle.

The device has a nozzle which does not need to spray continuously; since the foam blanket can last up to 40 minutes, depending upon conditions.

The device is easy to install into either existing building or new construction.

The device is a self-contained system; it does not depend upon outside electricity or water.

The device is easy to use, turn on the switch or even better use the remote control after you leave.

The device uses environmentally friendly foam which is easy to clean and the device can be programmed to automatically wash the foam away once the danger has passed.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
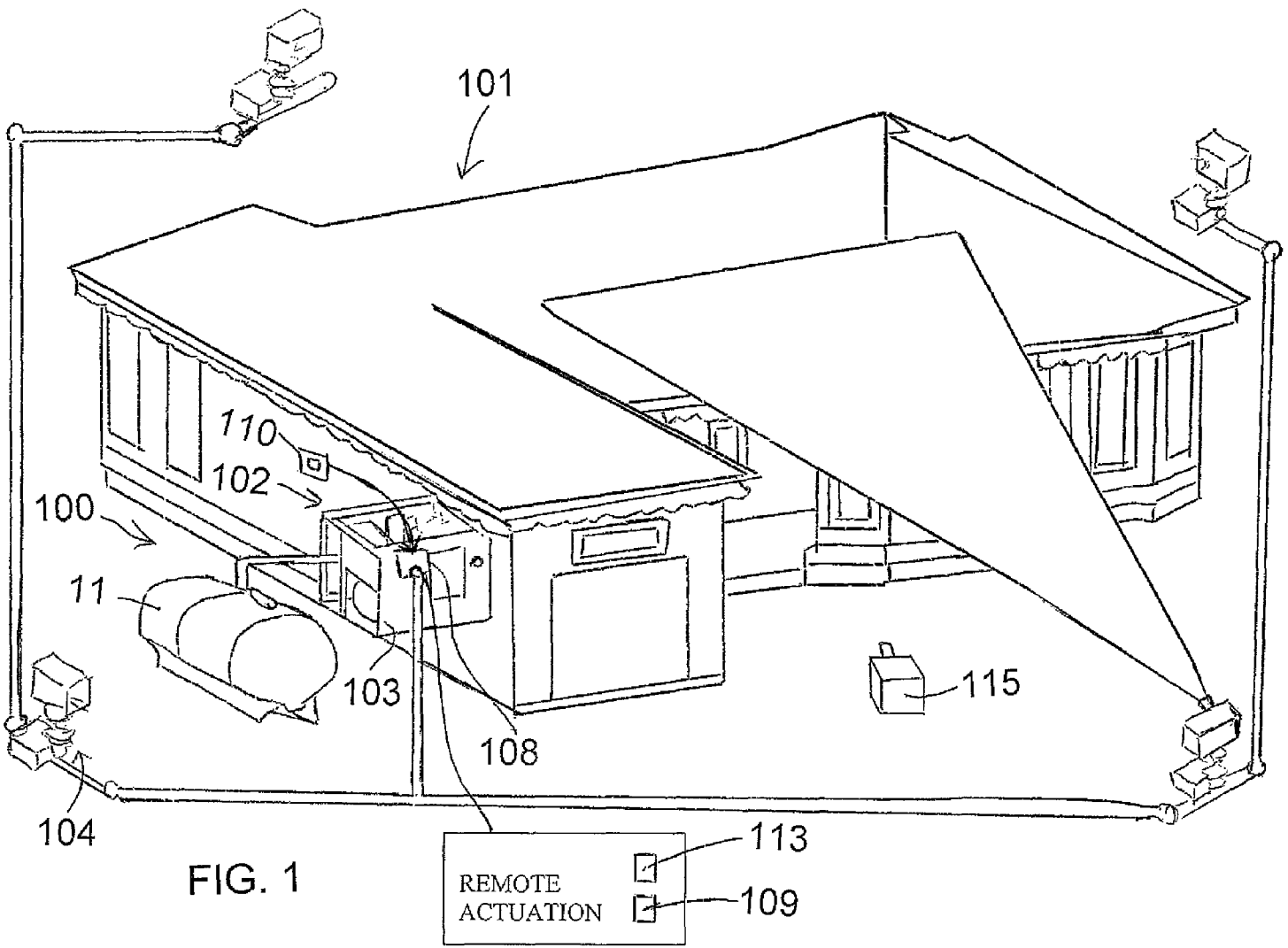
FIG. 1 is a schematic illustration of the system according to the present invention.

As shown in FIG. 1 there is provided an apparatus 100 for protecting a structure 101 from fire. Many such structures can be protected including primarily single family homes but also many other buildings which may be in the path of wild fires or other areas prone to fire. The intention is that the system be used to protect the exterior of the building from a passing fire. However the same system can be used in the interior of the building where a limited number of nozzles can be used to cover a sufficient part of the interior to protect against a fire starting in the interior.

In addition to homes, the system can be used to protect other structures such as remote antennas, pumping stations, shelters and any other structure of sufficient value to require protection.

The apparatus includes a water supply 11 which in the embodiment shown is a dedicated water tank but can be any permanent supply of water such as a lagoon or swimming pool.

Figure 2:
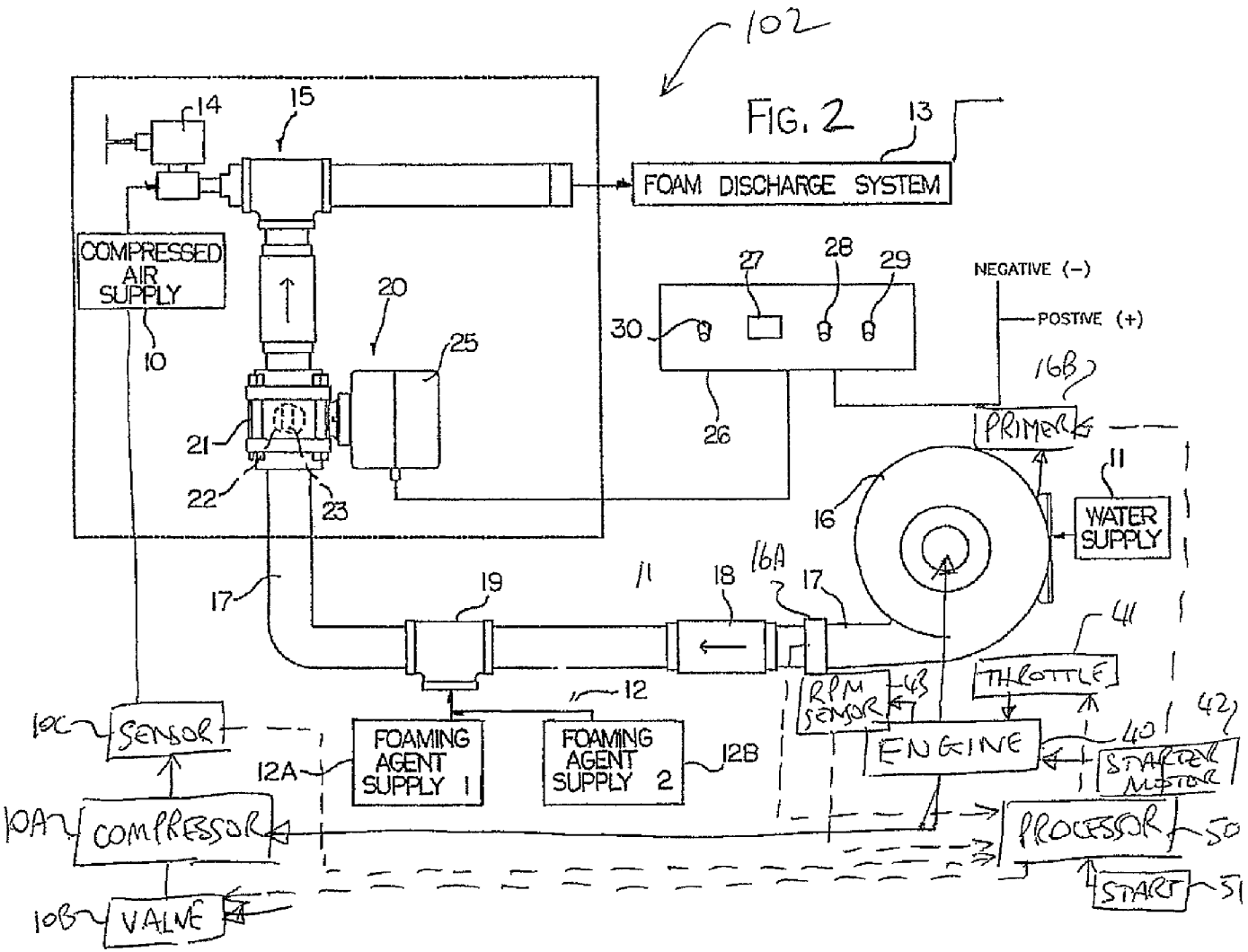
FIG. 2 is a schematic layout of the foam generation system of FIG. 1.
Figure 3:
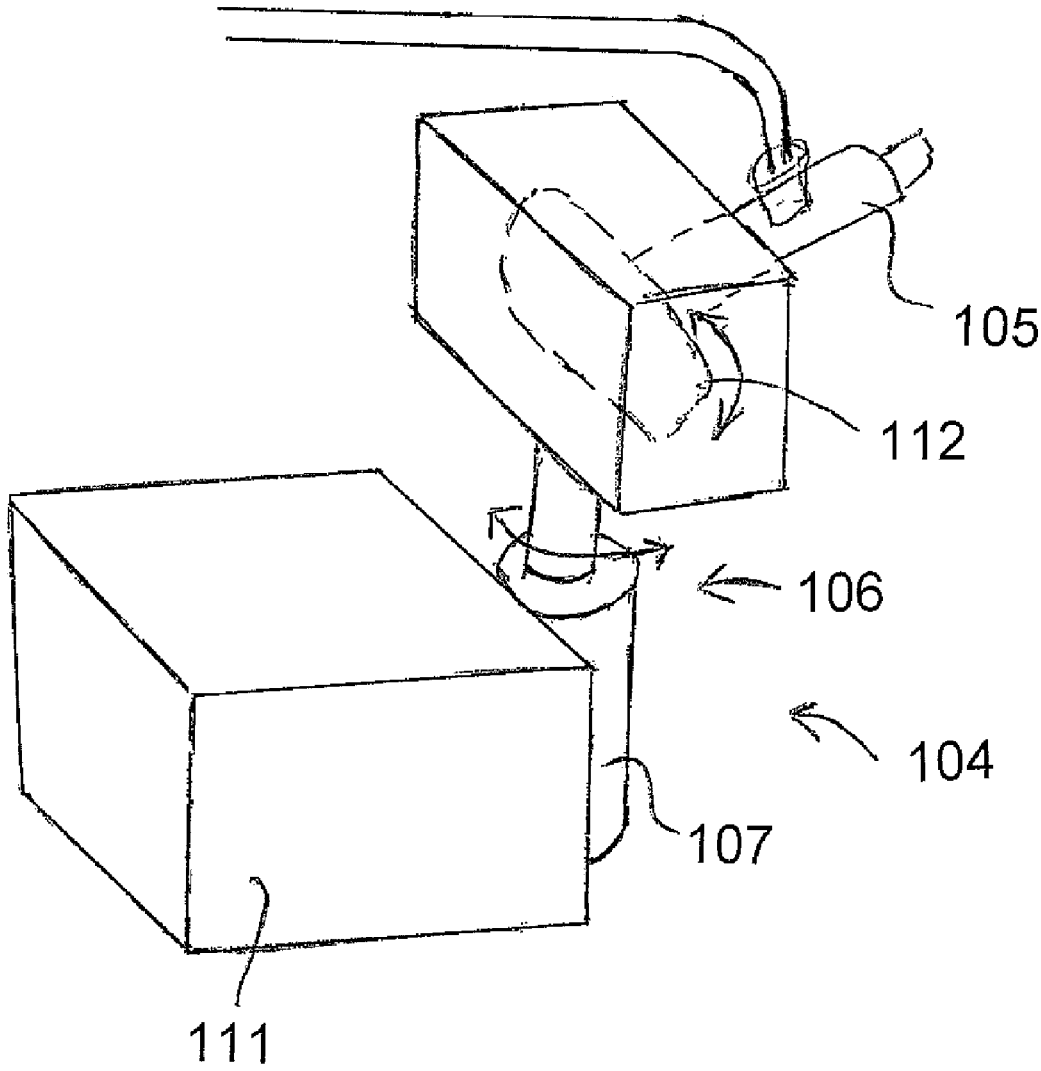
FIG. 3 is an enlarged view of one of the nozzles of FIG. 1.

A foam generation system 102 shown in more detail in FIG. 2 includes a source of compressed air under pressure. This can be a compressor 10A or can be a tank of compressed air (not shown). A pump 16 for pumping water to be foamed has a pump inlet for connection to the water supply 11 and a pump outlet 17. A source of a foaming agent in the form of one or more tanks 12A and 12B supplies a surfactant of known characteristics to a mixing system 15 for mixing the water, the compressed air and the foaming agent to generate a fire retardant foam.

In the preferred embodiment the compressor and pump are driven by a dedicated internal combustion engine 40 with all of the components of the foam generation system being mounted in a protective housing 103. The housing is located adjacent the building so as to fall within the protective zone defined by the foam.

The apparatus includes at least one and preferably a series of nozzle assemblies 104 for spraying the foam arranged at positions around the structure to be protected and arranged to apply a coating of foam over the whole structure. Each nozzle assembly 104 has a jet nozzle 105 and a motor arrangement 106 to move the nozzle to different directions for spraying a pattern over the structure. The motor arrangement includes a first motor 107 and a second motor 112 arranged to rotate the nozzle about two orthogonal axes which are preferably horizontal and vertical.

The apparatus includes a control system 108 which can be actuated by a remote actuation device 109 or by a local switch 110 to actuate and control the individual nozzles 104 in accordance with set programs. The system 108 communicates with a respective control device which 111 of each nozzle which is programable to provide a program of operation to control the motor or motors so as to pre-determine the pattern.

The control devices can be programed either at the central control unit 108 or at the individual units 111 to drive movement of the nozzles to combine to cover a structure to be protected. Thus each nozzle is scanned vertically and horizontally to "paint" an area of the structure with the foam as a layer. Thus the amount of vertical movement, preferably in stepped positions, and the amount of horizontal movement at each vertical position is controlled to match the shape to be covered.

Thus each nozzle can be programmed to apply a specific pattern different from one or more of the other nozzles depending on the shape of the structure and the locations of the nozzles relative to that structure. It will be appreciated that the initial programming of the nozzles is set up so as to ensure that the structure is fully covered using preferably a minimum number of nozzles with the nozzles being located and programed for best efficiency and adequate coverage.

After the initial installation, subsidiary programming can be provided to allow periodic operation of the system to ensure an adequate coating of foam is maintained to accommodate different levels of risk, depending on the situation surrounding the structure.

The remote actuation device 109 is arranged to select from a plurality of predetermined programs 113 of operation of the nozzle or nozzles. These programs particularly relate to the operation of the nozzles periodically with the time between operations being programable and the time period of operation being controllable.

The control device can be programmed to cycle from one nozzle to another at two or more rates depending on the intensity of the fire. Alternatively all nozzles may be operated simultaneously and controlled periodically or continually depending on required foam coverage.

In addition there may be there is provided a heat seeking sensor 115, such as an infra red detector, which detects local hot spots and acts to control one or more nozzles to apply foam to a specific heat location when detected.

The/or each nozzle typically uses only 40-60 gallons per minute of water to apply fire protection foam. The/or each nozzle is arranged reach up to 80 feet (30 meters) at a 45° angle. A coating can remain effective for up to 40 minutes. Using these parameters, the installer can select suitable location and programming of the nozzles and suitable supply of water to maintain the required coverage.

The apparatus is arranged as a self-contained system so that it does not depend upon outside electricity or water.

As a further programming of the control system, it can be programmed to use plain water with the nozzles to wash the foam away when the danger has fully passed.

Turning now to FIG. 2, further detail of the foam generation system are shown. This includes a compressed air supply 10, the water supply 11, the foaming agent supply 12 and a foam discharge system 13 supplying the foam to the nozzles 104.

The compressed air supply 10 includes a compressor 10A, an inlet control valve 10B to the compressor and a sensor 10C for detecting the presence of pressure at the outlet of the compressor.

The system further includes a control valve 14 which controls the supply of the compressed air from the compressed air supply 10 to a mixer 15 which is of the construction shown in the above patent.

The water from the water supply 11 is supplied to a pump 16 which generates water flow in an output line 17. Downstream of the pump is a sensor 16A for detecting presence of water pressure. A priming system 16B is located at the pump inlet which extracts any air from the pump inlet when activated. Priming devices for this purpose are available of different types, for example venturi activated devices which generate a suction to extract any air from the inlet. The water passes through a back check valve 18.

The pump 16 and the compressor 10A are driven by an engine 40 which is preferably a diesel engine. The engine 40 includes a throttle control 41, a starter motor 42, and an engine rpm sensor 43.

A processor or PLC control system 50 takes inputs from the sensors 10C, 16A and 43 and from an input start button 51 and controls the valve 10B, the throttle control 41, the primer 16B, and the starter motor 42.

An injector 19 of the type shown in the above patent adds to the water in the line 17 an amount of foaming agent proportional to the water flow. Thus the injector 19 is responsive to the water flow and adds the quantity of foaming agent necessary to match that water flow at the required ratio which is constant for all water flow rates. The supply 12 of foaming agent includes a first supply 12A and a second supply 12B for different types of foaming agent.

The flow rate within the duct 17 is controlled by a valve generally indicated at 20. The valve comprises a ball valve 21 which has a ball schematically indicated at 22 with an orifice 23 so that rotation of the ball varies the amount of the orifice accessible to the line 17 from 0 up to 100% thus continuously variably adjusting the flow rate from fully off to fully on. The ball is rotated through 90° by a motor 25 controlled by an electronic control system 26. A commercially available valve, motor and control unit is available and is suitable for use in an arrangement of this type.

The motor is thus a motor which drives the ball valve from fully closed to fully open through a series of pre-selected steps of the motor. A suitable commercially available device uses a potentiometer feed-back system which allows specific points on the potentiometer to be selected and the motor operated to move to those pre-selected positions of the potentiometer. The electronic controller 26 includes a display 27, setting switches 28 and 29 and a single operating switch 30.

In operation, the system is actuated by the switch 110 or by the remote 109 which acts to provide a start signal and the processor 50 controls the operation of the unit to generate foam as follows:

Step Description

1. Engage start switch 51
2. Time delay-glow plugs heat. The diesel engine includes conventional glow plugs which generate heat to allow the engine to start. The time delay is determined by the processor to allow sufficient heating to occur.
3. Starter motor 42 is engaged by the processor 50.
4. Starter motor is activated by the processor 50 runs for a preset time.
5. Check by the processor 50 of the sensor 43 for a minimum RPM indicative of start up.
6. If no start is detected, the processor returns to Step 1.
7. If a minimum RPM is detected indicative of start up of the engine, the processor 50 activates the air compressor 10A by opening the inlet valve 10B.
8. If pressure is detected by the sensor 10C, this is communicated to the processor which acts to activate the throttle control 41 to ramp up engine speed as the pressure increases.
9. The sensor 16A is sensed by the processor 41 to check for water pressure.
10. If no water pressure is sensed, the processor engages the air primer 16B.
11. The sensor 16A is sensed by the processor 41 to check for water pressure.
12. If water pressure is sensed, the processor disengages the air primer.
13. At the same time the processor acts to engage the pressure balance valve 25.
14. Unit is now read to make foam 15A. Open One touch valve
Air solenoid opens to One Touch line
15B. Select foam on foam/gel switch
Air solenoid opens to Foam/gel line
Foam/gel valve switches to foam
15C. Select gel on foam/gel switch
Foam/gel valve switches to gel
15D. Turn manual foam switch ON
Air solenoid to manual valve opens The flow rate of water and foaming agent necessary to generate certain characteristics of foam is previously determined. Thus three different characteristics of foam can be formed of dry, wet and extra wet as described in the above patent.

The control unit is therefore operated to select positions of the operation of the motor determined to provide the above three flow rates as measured at the output 13 in the absence of compressed air so that the volume of liquid flowing is accurately determined and adjusted by the set switches 28 and 29.

With the controller so set, the controller is arranged such that each operation of the operating switch 30 cycles the system through each of the five conditions in turn that is fully closed, dry, wet, super wet and fully open in turn with a further actuation of the switch returning the system to the fully closed position.

Thus with the system set to cycle in this manner and with the set positions selected at the locations of the motor so as to provide the accurately measured required flow rate, the compressed air supply is activated and the control switch 30 operated to supply the required quantity of water.

The control unit is further arranged so that when the control switch is operated to the fully closed position, the compressed air supply is also deactivated so that the system is off.

The control unit is also arranged so that when the cycling switch 30 moves the control of the pump to the fully opened position, the compressed air supply is also switched off. At the same time the foaming agent from the supply 1 which is used with the compressed air foam is replaced with other foaming agents on supply 2 which can be used for foaming only water so that when the water supply is on full, no compressed air is added and the foaming agent from the supply 2 acts in the mixer to generate the required foam. In some cases, depending upon the type of foaming agent used, and many are available, the same foaming agent may be used for both functions with the amount being increased approximately three-fold for the non-compressed air foam.

In FIG. 2 is shown an alternative control unit 41 which includes a single pole two position on-off switch 40 and five momentary switches 42 each of which provides a pre-set for the conditions previously stated. Each switch 42 is associated with a respective LED 43 which is illuminated to indicate to the user the condition which has been selected by depression of the switch concerned.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

The invention claimed is:

1. Apparatus for protecting a structure from fire comprising:

a source of compressed air under pressure;

a pump for pumping water to be foamed having a pump inlet for connection to a water supply and a pump outlet;

a source of a foaming agent;

a mixing system for mixing the water, the compressed air and the foaming agent to generate a fire retardant foam;

a plurality of separate nozzles each arranged for spraying the foam;

each nozzle having a motor arrangement to move the nozzle to different directions for spraying a pattern;

and a control device which is programable to provide a program of operation to control the motors of the nozzles;

the control device being programmed with at least one pre-determined program arranged to control each of the nozzles independently to provide for each nozzle a pre-determined pattern where the pattern of at least one nozzle is different from the pattern of one or more of the other nozzles;

the control device being arranged so that the different patterns of the nozzles combine to form a pre-determined pattern of a layer of the fire retardant foam on the structure to cover the structure with the layer to protect the structure from fire.

2. The apparatus according to claim 1 wherein there is provided a remote control for communication with the control device for remote actuation.

3. The apparatus according to claim 1 wherein the control device includes a plurality of predetermined programs of operation of the nozzles; where the predetermined programs are arranged to provide different ones of a plurality of predetermined patterns of the fire retardant foam on the structure.

4. The apparatus according to claim 1 wherein the control device is programmed with said at least one pre-determined program arranged to operate the nozzles periodically with the time period between operations being programable.

5. The apparatus according to claim 1 wherein there is provided a remote control for communication with the control device and wherein the remote control is arranged to select one of a plurality of programs of operation of the control device.

6. The apparatus according to claim 1 wherein the control device is programmed with said at least one pre-determined program which is arranged so that the nozzles cooperate to cover a surface by the foam.

7. The apparatus according to claim 1 wherein there is provided a sensor for detecting a heat intensity indicative of an intensity of a fire on the structure and wherein the control device is programmed in response to a signal from the sensor to cycle from one nozzle to another at two or more rates depending on the intensity of the fire.

8. The apparatus according to claim 1 wherein there is provided a heat seeking sensor for detecting a location within the structure which has a temperature indicative of combustion occurring at the location and wherein the control device is responsive to said heat seeking sensor to control said motor of said at least one nozzle to apply said foam to said location when detected.

9. The apparatus according to claim 1 wherein each nozzle is arranged reach to 80 feet at a 45° angle.

10. The apparatus according to claim 1 wherein the control device is programmed in a subsequent step to use plain water with the nozzles to wash the sprayed foam away.

11. The apparatus according to claim 1 wherein there is provided an internal combustion engine for driving the pump and a compressor for the compressed air.

12. The apparatus according to claim 11 wherein there is provided a processor for controlling starting and operation of the internal combustion engine, for controlling the compressor and for controlling the pump in response to outputs from sensors such that foam is available to be supplied solely upon supply of an actuation signal from the control device.

13. The apparatus according to claim 12 wherein the processor is arranged to be responsive to a first sensor to check for a predetermined minimum rpm to indicate starting of the engine.

14. The apparatus according to claim 13 wherein the processor is arranged to be responsive to said first sensor indicating said predetermined minimum rpm to operate the airflow valve to enable the air compressor.

15. The apparatus according to claim 13 wherein the processor is arranged to be responsive to a second sensor to detect the presence of air pressure generated by the compressor to actuate ramp up of engine rpm from an idle speed to an operating speed.

16. The apparatus according to claim 15 wherein there is provided a pump priming system operable to release any existing air in the pump and wherein the processor is responsive to the absence of pump flow detected by a third sensor to actuate the pump priming system.

17. The apparatus according to claim 16 wherein there is provided a pressure balance valve for controlling the supply of air and water and wherein the processor is responsive to the detection of water flow by the third sensor to actuate the pressure balance valve.

* * * * *